United States Patent [19]

Brenneman

[11] Patent Number: 4,478,064

[45] Date of Patent: Oct. 23, 1984

[54] MODIFICATIONS TO A COOPERATIVE ROLLING SYSTEM FOR INCREASING MAXIMUM ATTAINABLE REDUCTION PER PASS

[75] Inventor: William L. Brenneman, Cheshire, Conn.

[73] Assignee: Olin Corporation, New Haven, Conn.

[21] Appl. No.: 355,090

[22] Filed: Mar. 4, 1982

[51] Int. Cl.[3] ..... B21B 1/22; B21B 29/00; B21B 37/08; B21B 31/32

[52] U.S. Cl. ..... 72/232; 72/243; 72/245; 72/249; 72/366

[58] Field of Search ..... 72/245, 232, 243, 240, 72/205, 226, 234, 241, 365, 366, 249; 425/194, 224; 264/175

[56] References Cited

U.S. PATENT DOCUMENTS

| | | | |
|---|---|---|---|
| 2,291,361 | 7/1942 | Walsh . | |
| 2,316,067 | 4/1943 | Hickman . | |
| 2,332,796 | 10/1943 | Hume . | |
| 2,370,895 | 3/1945 | Wean . | |
| 2,392,323 | 1/1946 | Koss . | |
| 2,526,296 | 10/1950 | Stone . | |
| 3,172,313 | 3/1965 | Fox | 72/241 X |
| 3,238,756 | 3/1966 | Coffin, Jr. . | |
| 3,253,445 | 5/1966 | Franek . | |
| 3,332,292 | 7/1967 | Roberts . | |
| 3,377,830 | 4/1968 | Campbell . | |
| 3,394,574 | 7/1968 | Franek et al. . | |
| 3,527,078 | 8/1968 | Lawson et al. . | |
| 3,709,017 | 1/1973 | Vydrin et al. . | |

(List continued on next page.)

FOREIGN PATENT DOCUMENTS

| | | |
|---|---|---|
| 50860 | 8/1970 | Australia . |
| 46551 | 3/1974 | Australia . |
| 691139 | 12/1965 | Belgium . |
| 363259 | 11/1922 | Fed. Rep. of Germany . |
| 1506671 | 12/1967 | France . |
| 1506680 | 12/1967 | France . |
| 2371246 | 8/1978 | France . |

(List continued on next page.)

OTHER PUBLICATIONS

Coffin, Jr., "Status of Contact-Bend-Stretch Rolling", *Journal of Metals,* Aug. 1967, pp. 14-22.

Vydrin et al., "New Sheet-Rolling Process from Russia", *Machinery and Production Engineering,* vol. 128, No. 3319, Jul. 21, 1976, Burgess Hill, Sussex, Great Britain.

Hollman et al., "Shear Rolling, A New Cold Rolling Method-Rolling Process and Rolling Mill Equipment", Stahl and Eisen, vol. 99, No. 6, Mar. 26, 1979, Dusseldorf, Germany.

Hoffman et al., *Introduction to the Theory of Plasticity for Engineers,* McGraw-Hill, 1953, pp. 214-239.

Tobin et al., "Control of Thickness of Metal Sheet and Strip", *Sheet Metal Industries,* Mar. 1960, pp. 203-213.

Robertson et al., "Further Experimental Data on Rolling Tin-Plated Strip in the S-Mill", *Metals Technology,* Jul. 1977, pp. 365-374.

*Primary Examiner*—Francis S. Husar
*Assistant Examiner*—Steven B. Katz
*Attorney, Agent, or Firm*—Barry L. Kelmachter; Paul Weinstein; Howard M. Cohn

[57] ABSTRACT

A process for rolling a metal strip for reducing its thickness and for increasing the maximum reduction attainable per pass using a cooperative type rolling mill comprises applying differential separating forces to the metal strip without changing the magnitude of the compressive force applied to the rolls. By doing this, the maximum strip tension and the forward tension required to pull the strip through the mill may be reduced. The maximum strip tension and the required forward tension force may further be reduced by driving at least one work roll at a desired value of torque as well as applying differential separating forces. The cooperative type rolling mill uses a roll spacing arrangement to space at least some of the rolls for reducing the separating force applied to the metal strip at selected roll bites. In addition, individual drive motors to drive the work rolls at desired torque values may be utilized.

19 Claims, 5 Drawing Figures

U.S. PATENT DOCUMENTS

| | | | |
|---|---|---|---|
| 3,798,950 | 3/1974 | Franek et al. . | |
| 3,811,307 | 5/1974 | Vydrin et al. . | |
| 3,823,593 | 7/1974 | Vydrin et al. . | |
| 3,861,188 | 1/1975 | Kamit et al. . | |
| 3,871,221 | 3/1975 | Vydrin et al. . | |
| 3,911,713 | 10/1975 | Vydrin et al. . | |
| 4,244,203 | 1/1981 | Pryor et al. . | |
| 4,253,322 | 3/1981 | Vydrin et al. . | |
| 4,257,252 | 3/1981 | Vydrin et al. . | |
| 4,267,720 | 5/1981 | Vydrin et al. . | |
| 4,329,863 | 5/1982 | Pryor et al. | 72/205 |

FOREIGN PATENT DOCUMENTS

| | | |
|---|---|---|
| 54-5848 | 1/1979 | Japan . |
| 54-10258 | 1/1979 | Japan . |
| 1002936 | 9/1965 | United Kingdom . |
| 1086643 | 10/1967 | United Kingdom . |
| 1087097 | 10/1967 | United Kingdom . |
| 1117585 | 6/1968 | United Kingdom . |
| 1125554 | 8/1968 | United Kingdom . |
| 1219967 | 1/1971 | United Kingdom . |
| 1223188 | 2/1971 | United Kingdom . |
| 2004486A | 4/1979 | United Kingdom . |
| 259793 | 4/1970 | U.S.S.R. . |

MODIFICATIONS TO A COOPERATIVE ROLLING SYSTEM FOR INCREASING MAXIMUM ATTAINABLE REDUCTION PER PASS

This invention relates to a process and apparatus for obtaining increased reductions in the thickness of metal strip. The invention is applicable to a wide range of metals and alloys which are capable of plastic deformation. The process and apparatus comprise modifications to the cooperative rolling process and apparatus to reduce strip tension and to increase the maximum reduction attainable per pass.

Conventionally, rolling mills are found with many different configurations, including two high, four high, and cluster mills. With these conventional mills, the total reduction which can be achieved in the metal strip before annealing is required is determined by the roll separating force generated during the rolling operation. This separating force increases from pass to pass as the metal strip becomes work hardened until a maximum limit is reached for the mill. When the separating force reaches a sufficiently high level, roll flattening, mill elasticity and strip flow strength are in balance and the mill ceases to make any significant further reductions in the strip thickness. Normally, prior to the strip reaching such a separating force level, further rolling is uneconomic and the strip is annealed to make it softer and thereby reduce the separating force in the next pass through the mill.

It is desirable that the percent reduction in thickness per pass and the total reduction which can be taken in the strip by a rolling mill between anneals be as large as possible so as to reduce the need for costly and time-consuming anneals. Various approaches have been described in the prior art for achieving such increases in available reduction in thickness between anneals. In most of these techniques, a stretching component has been added to the rolling reduction in order to provide increased percentages of reduction.

One such approach comprises contact bend stretch rolling, also known as C-B-S rolling. This technique is illustrated in U.S. Pat. No. 3,238,756 to Coffin, Jr., in an article by Coffin, Jr. in *The Journal of Metals*, August 1967, pages 14–22, and in U.K. Patent Specification No. 1,125,554 to Coffin, Jr. In the C-B-S rolling process plastic bending is provided in conjunction with longitudinal tension and rolling pressure to provide strip or foil thickness reductions. In addition, the rolling mill utilizes a speed ratio between the contact rolls as a means for determining and controlling reduction in place of a conventional rigid roll gap. The strip enters the mill and is threaded around a large roll called the entry contact roll. The strip is then wound about a small floating roll called the bend roll. The bend roll is cradled in the gap between the first large roll and a second large roll called the exit contact roll. The strip is maintained under tension to prevent slipping between the strip and the two contact rolls. The contact rolls are driven at a fixed ratio of surface speed with respect to one another. Reduction occurs at two bite points between the bend roller and the two contact rolls. The reduction is the consequence of the drawing or the stretching of the strip around the small bend roll and the forcing of the strip up into the gap between the two contact rolls where it is squeezed, bent, and rolled sufficiently at both reduction points to match the speed ratio. This apparatus is more fully described in the aforenoted article and patents by Coffin, Jr. The C-B-S process is subject to a number of difficulties as are well known in the art. In particular, it is difficult to lubricate the bend roll and, because of its very small diameter, it rotates at high speeds and tends to heat up and distort. This can cause irregularities in the resultant strip.

Yet another prior art approach comprises a process of rolling metal sheet commonly referred to as "PV" rolling. This process is amply described in U.S. Pat. Nos. 3,709,017 and 3,823,593 both to Vydrin et al. In this process the sheet is rolled between driven rolls of a rolling mill wherein each adjacent roll is rotated in an opposite direction to a next adjacent roll and at a different peripheral speed with respect thereto. The process is effected with a ratio between the peripheral speeds of the rolls controlling the reduction of the strip being rolled. The rate of travel of the delivery end of the strip is equal to the peripheral speed of the driving roll that is rotated at a greater speed. Tension is applied to at least the leading portion of the strip and the application of back tension is also described. The strip may be wrapped in a manner so as to encompass the rolls through an arc of 180° or more.

PV rolling is normally carried out using relatively large diameter rolls of equal diameter. This is so because of the high torque required to drive the rolls. However, by employing large diameter rolls, it is difficult to get a large bite and, therefore, a large reduction in strip thickness per pass. Further, the maximum total reduction achievable with a PV rolling mill between anneals is governed by roll flattening. Roll flattening is a more serious problem with large work rolls than with small work rolls.

U.S. Pat. Nos. 3,811,307, 3,871,221, 3,911,713, 4,253,322, 4,257,252, 4,267,720 all to Vydrin et al., U.K. Patent Application No. 2,004,486A to Vydrin, French Demande De Brevet D'Invention No. 2,371,246 to Vydrin et al., "New Sheet Rolling Process from Russia", *Machinery and Production Engineering*, Vol. 128, No. 3319, July 21, 1976, Burgess Hill, Sussex, Great Britain, and "Shear Rolling, A New Cold Rolling Method—Rolling Process and Rolling Mill Equipment", Hollmann et al., *Stahl and Eisen*, Vol. 99, No. 6, Mar. 26, 1979, Dusseldorf, Germany discuss various aspects of PV rolling as well as modifications and improvements which have been made to the PV rolling mill and process. In U.S. Pat. No. 4,253,322, a method of controlling the thickness of strip stock being rolled is disclosed. In this method, an adjusting force is established for moving the supports of one of the rolls. The magnitude of the adjusting force is greater than the rolling force and is applied to the roll supports to overcome the rolling force, the difference between the adjusting force and the rolling force causes the roll supports to move. Another force is established proportionate to the amount of the movement so as to prevent the supports of the rolls, between which the strip stock is deformed, from moving towards each other and to balance the difference between the adjusting force and the rolling force. The factor of proportionality between the movement of the roll supports and the balancing force is in a definite predetermined ratio with the mill stand stiffness factor. The adjusting force is changed in the course of strip stock deformation to compensate for the roll gap variation.

Many other techniques have been suggested for rolling in a non-conventional manner wherein there is stretching of the strip. Illustrative of such processes and apparatuses are U.S. Pat. No. 2,291,361 to Walsh; U.S. Pat. No. 2,316,067 to Hickman; U.S. Pat. No. 2,332,796 to Hume; U.S. Pat. No. 2,370,895 to Wean; U.S. Pat. No. 2,392,323 to Koss; U.S. Pat. No. 2,526,296 to Stone; U.S. Pat. No. 3,253,445 to Franek; U.S. Pat. No. 3,332,292 to Roberts; U.S. Pat. No. 3,377,830 to Campbell; U.S. Pat. No. 3,527,078 to Lawson et al.; U.S. Pat. No. 3,798,950 to Franek et al.; and U.S. Pat. No. 3,861,188 to Kamit et al.; Australian Patent Document Nos. 46,551 and 50,860; Belgium Patent Document No. 691,139; Fed. Rep. of Germany Patent Document No. 363,259; French Pat. Nos. 1,506,671 and 1,506,680; Japanese Pat. Nos. 54-5848 and 54-10258; U.K. Patent Specification Nos. 1,002,936; 1,086,643; 1,087,097; 1,117,585; 1,219,967 and 1,223,188; Russian Pat. No. 259,793; *Introduction to the Theory of Plasticity for Engineers,* Hoffman et al., McGraw-Hill, 1953, pp. 214–239; "Further Experimental Data On Rolling Tin-Plated Strip In The S-Mill", Robertson et al., *Metals Technology,* July, 1977, pp. 365–374; and "Control of Thickness of Metal Sheet and Strip", Tobin et al., *Sheet Metal Industries,* March 1960, pp. 203–213.

The Robertson et al. article discusses the S-mill rolling process which incorporates plastic bending under tension in conjunction with roll pressure to reduce strip thickness. The strip is wrapped around a plurality of work rolls and provides support, thus eliminating the need for a multiplicity of supporting rolls. Since the strip is drawn through the rolls, the process is limited by the front tension the strip will carry. Robertson et al. conducted experiments in which the larger work roll was driven. The results obtained from these experiments showed that when the work roll was driven with positive torque, little difference was detected in strip tensions. However, when the larger work roll acted as a brake, substantial reductions were found to occur in both the front and back strip tensions.

U.K. Patent Specification No. 1,223,188 to Grinsted discloses a rolling mill having positively driven back-up rolls and work rolls having diameters which are small as compared with that of the back-up rolls located between the back-up rolls to form therewith an S-shaped path through which the strip is moved lengthwise. Grinsted discloses applying a torque to the work rolls by driving the work rolls with individual motors.

A similar approach is described in U.S. Pat. No. 3,394,574 to Franek et al. In this patent there is described an apparatus and process for rolling strip metal wherein the rolling mill includes first and second back-up rolls arranged in spaced relation for rotation about fixed axes. The back-up rolls are positively driven so that the second has a peripheral speed greater than the first. Disposed between the back-up rolls are first and second freely-rotatable work rollers each of which has a diameter small as compared with that of the back-up rolls. The work rolls are movable bodily relative to the back-up rolls and cooperate one with the other and one with each of the back-up rolls. A stabilizing roller is used to apply pressure to one of the work rollers relative to a back-up roll.

In Franek et al. the strip is moved lengthwise under tension through a path defined by encompassing the strip about the first back-up roll and then in an "S" shape about the work rolls and then encompassing the strip about the second back-up roll. The work rolls are arranged so that a tension load applied to the strip provides the sole means for producing the rolling load at each of the three nips defined by the respective rolls. In the Franek et al. process and apparatus the rolling load is produced solely by the lengthwise tension in the strip.

Approaches such as C-B-S rolling and the one described in the Franek et al. patent suffer from several drawbacks in addition to those already described above. Since the strip tension is the active element in creating the force between the rolls at each roll nip, it must be relatively high. It is difficult to roll soft strip which would be subject to breaking or other shape problems such as waviness because of the high degree of tension force required. The use of high amounts of tension as would be required by Franek et al. could create internal defects in the strip and any strip with edge cracking tendencies or which would be notch brittle would be difficult to roll. Further, the apparatus is complicated by the necessity of a stabilizing means such as a stabilizing roll.

These difficulties which arise from the necessity of using high amounts of tension in the process are also shared by many of the other non-conventional rolling techniques described above. It has been found desirable to provide a rolling mill which can process metal strip with high percentages of reduction in thickness between anneals without the deficiencies of the prior art. In order to achieve large bites in the nip of rolls, it is desired to utilize small diameter rolls. However, the diameter and arrangement of the rolls should not be so small as to make it difficult to lubricate and cool the mill. U.S. Pat. No. 4,244,203 to Pryor et al. discloses such a mill. The cooperative rolling mill apparatus and process of Pryor et al. passes a strip material through a modified four high rolling mill in a serpentine arrangement to provide, for example, three reductions per pass.

Allowed U.S. patent application Ser. No. 167,084, filed July 9, 1980, now U.S. Pat. No. 4,329,863, to Pryor et al. discloses a modification to the cooperative rolling mill apparatus and process to make the last reduction in any pass schedule the lightest or smallest reduction. In accordance with the invention described therein, at least one of the roll gaps in the mill is fixed and at least one of the roll gaps in the mill is left floating. By this arrangement, it is possible to alter the equilibrium gap spacings so that a greater percentage reduction is taken in the first roll bite and a small percentage reduction is taken in the final roll bite. At least one gap may be fixed using such means as fixed dimension separator blocks and clamps, adjustable inclined plane spacer blocks, hydraulic cylinders, etc. At a fixed gap, the strip will be subjected to an increased separating force because of the manner in which the gap is fixed. Co-pending U.S. patent application Ser. No. 260,491, filed May 4, 1981, now U.S. Pat. No. 4,412,439, to Brenneman and U.S. patent application Ser. No. 301,331, filed Sept. 11, 1981, now U.S. Pat. No. 4,414,832, to Brenneman et al. disclose other modifications and/or improvements to the cooperative rolling apparatus and process.

The cooperative rolling process and apparatus roll metal strip by non-symmetrical plastic flow. Unusually high rolling reductions per pass and total rolling reductions between anneals are achieved within the confines of the modified four high rolling mill. The cooperative rolling approach makes maximum utilization of the deformation ability of metallic strip by optimization of roll compression and stretch elongation to derive maximum ductility.

The unusual results in accordance with cooperative rolling are obtained by modifying a standard four high rolling mill although various other configurations are possible. The modification of the rolling mill involves primarily changing the drive mechanism in order to assure that the mill is driven by the back-up rolls and to provide some means by which the back-up rolls can be driven at different speeds. The mill is then strung up or threaded so that the incoming strip is wrapped around the slower moving driven back-up roll and then forms an "S" shaped bridle around the substantially smaller diameter work rolls. Finally, it exits the mill by encompassing the fast moving driven back-up roll.

When this is done and the cooperative rolling mill is powered and put under appropriate pressure by a screw down mechanism, three reductions are obtained. The first reduction point is between the first driven slow roll and its adjacent first work roll. The second reduction is taken between the two work rolls and the third reduction which is similar to the first reduction is taken between the second work roll and the second back-up roll. The separating force applied to the strip at each of the reduction points as a result of the pressure applied by the screw down mechanism has substantially the same magnitude at each of the reduction points. This cooperative rolling approach results in three rolling reductions being accomplished in one pass of the strip through the mill.

The mechanisms which govern the reduction at each of the bites of the cooperative rolling mill tend towards reducing the separating force required for rolling. Forward and back tension for the process is provided by wrapping the metal strip around the driven back-up rolls in such a way so as to provide shear drag on the workpiece. The strip is also tensioned as it enters and leaves the mill by conventional means such as decoilers/recoilers.

By using the exit back-up roll motor and a tensioning means such as a recoiler to pull the strip through the mill, maximum strip tension occurs at the third or exit reduction point since both the exit back-up roll motor and the tensioning means act on the strip substantially at or just after the strip exits the third reduction point. Since strip tension increases with increasing reduction, primarily due to the wedge forces in the roll bites forming the reduction points, the maximum reduction attainable per pass is limited by the tensile strength of the strip at the third or exit roll bite.

In order to increase the maximum reduction in strip thickness attainable per pass, it is desirable to reduce the maximum strip tension and to reduce the forward recoiler tension force that need be applied to the strip to carry out the rolling process. In accordance with the present invention, a rolling apparatus and process is provided, preferably of the cooperative type, wherein a differential separating force concept, preferably comprising progressively increasing separating forces being applied to the strip between the first or entry roll bite and the third or exit roll bite, is utilized to reduce the maximum strip tension and the minimum allowable forward recoiler tension. The differential separating force concept utilizes spacing devices between the roll support mechanisms to divert a portion of the separating forces at selected roll bites so that the separating forces applied to the strip at these roll bites are reduced by a desired magnitude.

In a second embodiment, the maximum strip tension and minimum allowable forward recoiler tension are further reduced by driving at least one of the work rolls at a desired torque value as well as using the differential separating force concept described herein. By using this arrangement, each driven work roll would be free to move substantially at the speed of the strip that is wrapping the roll and to assist in pulling the strip through the mill.

Accordingly, it is an object of this invention to provide an improved process for rolling metal strip.

It is a further object of this invention to provide a process as above for increasing the maximum reduction attainable per pass.

It is a further object of this invention to provide a process as above for reducing the maximum strip tension and the forward recoiler tension force that need be applied to the metal strip.

These and other objects will become more apparent from the following description and drawings.

Figure 1:
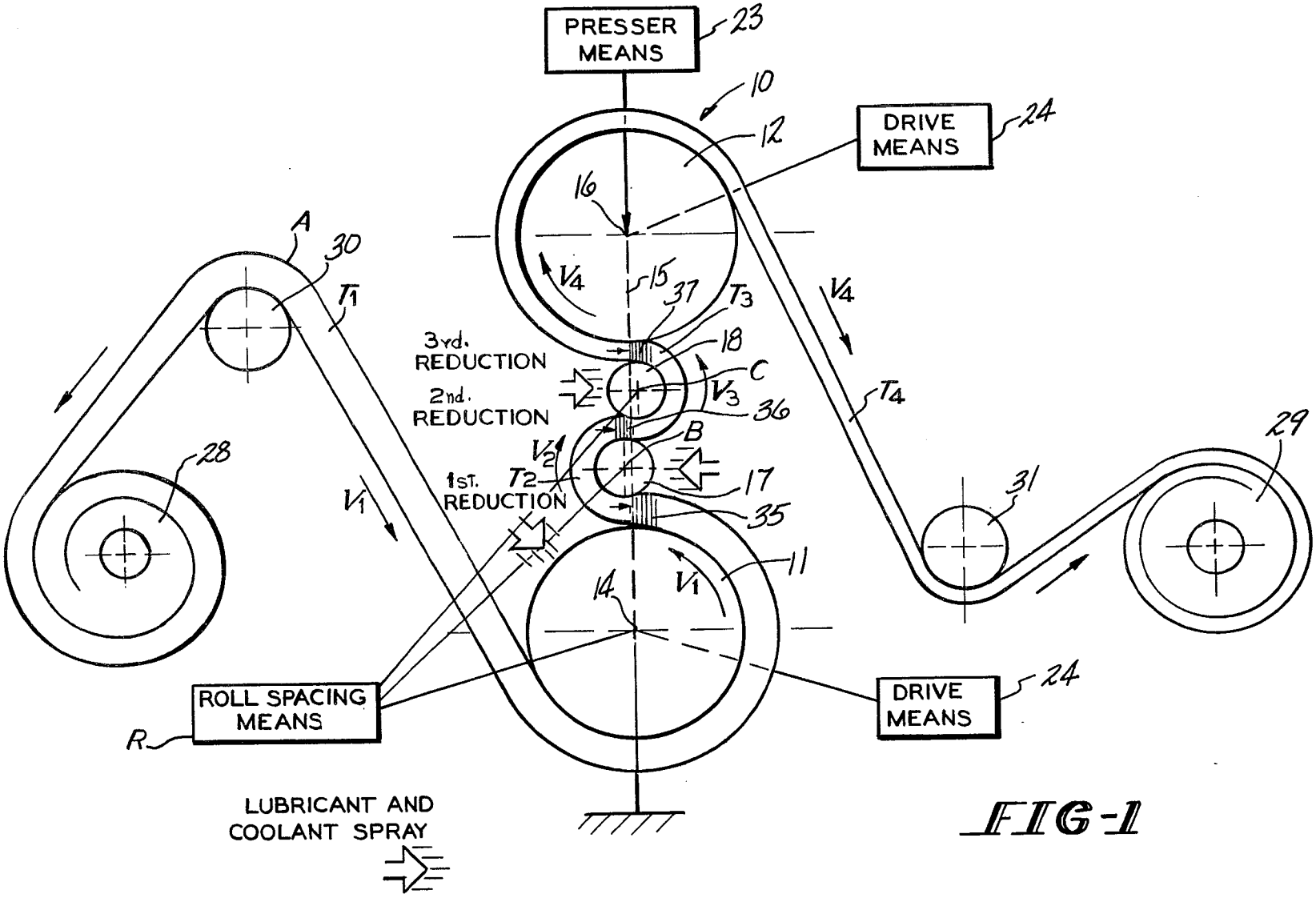
FIG. 1 is a schematic illustration of a side view of an apparatus in accordance with an embodiment of this invention.
Figure 3:
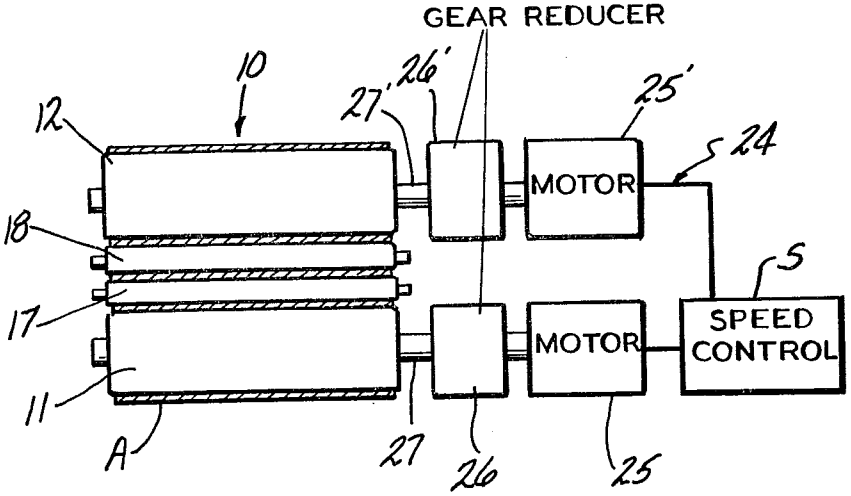
FIG. 3 is a partial view showing the drives to the rolls of the apparatus of FIG. 1.

In accordance with this invention a rolling process and apparatus is provided, preferably of the cooperative type. The rolling system optimizes bi-axial forces to maximize rolling reduction through a process of non-symmetrical plastic flow. It is applicable to any desired metal or alloy which can be plastically deformed It is particularly adapted for processing metal strip. Unusually high rolling reductions per pass and total rolling reductions between anneals with excellent surface finish and microstructure can be achieved through the use of a four high rolling mill modified in accordance with this invention. The approach of this invention makes maximum utilization of the deformation ability of the metallic strip by optimization of roll compression and stretch elongation to derive maximum ductility.

The modification of the rolling mill involves primarily changing the drive mechanism so that the mill is back-up roll driven, the provision of some means for driving the back-up rolls at respectively different speeds one from the other, and means for diverting a portion of the separating force at selected roll bites so that the separating forces applied to the metal strip progressively increase as the metal strip passes through the mill.

Referring now to FIGS. 1–4, there is shown by way of example a cooperative rolling mill 10 in accordance with a preferred embodiment of the present invention. The cooperative rolling mill 10 comprises first 11 and second 12 back-up rolls of relatively large diameter. The lower back-up roll 11 is journaled for rotation in the machine frame 13 of the rolling mill 10 about a fixed horizontal roll axis 14. The upper back-up roll 12 is journaled for rotation in the machine frame 13 about roll axis 16 and is arranged for relative movement toward and away from the lower back-up roll 11 along the vertical plane 15 defined by the back-up roll axes 14 and 16. Arranged between the upper 12 and lower 11 back-up rolls are two free wheeling work rolls 17 and 18 having a diameter substantially smaller than the diameter of the back-up rolls 11 and 12. The work rolls 17 and 18 are journaled for rotation and arranged to idle in the machine frame 13. They are adapted to float in a vertical direction along the plane 15. The specific support mechanisms 19, 20, 21, and 22, etc., for the respective rolls 11, 12, 17 and 18 of the mill 10 may have any desired structure in accordance with conventional practice as amply illustrated in the various patents cited hereinbefore.

A motor driven screw down presser means 23 of conventional design is utilized to provide a desired compressive force between the back-up rolls 11 and 12 and their cooperating work rolls 17 and 18 and between the work rolls themselves. The arrangement discussed thus far is in most respects similar to the arrangement of a conventional four high rolling mill.

In accordance with this invention, a conventional mill is modified by changing the speed relationship between the lower back-up roll 11 and the upper back-up roll 12 such that the peripheral speed of the lower back-up roll $V_1$ is less than the peripheral speed $V_4$ of the upper back-up roll 12. This can be accomplished relatively easily by a two motor drive 24 as in FIG. 3 which will drive the upper back-up roll 12 at a higher speed relative to the lower back-up roll 11 in proportion to the desired reduction in thickness of the strip A passing through the mill. The back-up rolls 11 and 12 are driven by motors 25 and 25' which are connected to the rolls 11 and 12 through reduction gear boxes 26 and 26' and drive spindles 27 and 27'. A speed control S is connected to the motors 25 and 25' in order to drive the rolls 11 and 12 at the desired speed ratio. The particular drive system 24 which has been described above does not form part of the present invention, and any desired drive system for driving the rolls 11 and 12 at the desired peripheral speed ratio could be employed. The drive to the work rolls 17 and 18 is provided by the back-up rolls 11 and 12 acting through the encompassing strip A.

In a conventional four high rolling mill a single rolling bite would be taken in the strip A as it passed through the nip between the work rolls. In accordance with this preferred embodiment, the strip A is strung or threaded as shown in FIG. 1 whereby the incoming strip is wrapped around the slower moving back-up roll 11 and then forms an "S" shaped bridle around the work rolls 17 and 18 and finally exits by encompassing the fast moving back-up roll 12. In this manner three reductions as shown in FIG. 1 are taken in the strip A as it passes through the mill 10. The first reduction is between the slower moving lower back-up roll and its cooperating lower work roll 17. The second reduction is between the lower and upper work rolls 17 and 18. The third reduction is between the upper work roll 18 and its cooperating fast moving upper back-up roll 12. Front and back tensions $T_4$ and $T_1$ are applied to the strip A in a conventional manner by any desired means such as the decoilers/recoilers 28 and 29. Billy rolls 30 and 31 arranged as shown are used to redirect strip A direction to provide the desired wrapping about the back-up rolls 11 and 12.

The strip A encompasses each of the work rolls 17 and 18 through about 180° of the circumference of the rolls. In the embodiment shown, the strip A encompasses each of the back-up rolls 11 and 12 to a greater extent, namely, about 270°. Since the strip A only encompasses the work rolls through about 180°, it is relatively easy to apply coolant and lubricant as shown in FIG. 1. The specific apparatus for applying the coolant and lubricant may be of any desired conventional design as are known in the art. The large size of the back-up rolls 11 and 12 also allows for relatively easy application of coolant and lubricant as shown even with a high degree of wrap.

In operation of a cooperative rolling mill, the strip A is threaded through the mill 10 in the manner shown in FIG. 1, and suitable forward and back tensions $T_4$ and $T_1$ are applied to the leading and trailing portions of the strip A by means of the decoilers/recoilers 28 and 29. The presser means 23 which may be of any conventional design and which may be hydraulically actuated (not shown) or screw 32 actuated through a suitable motor drive 33 is operated to apply a desired and essential operating pressure or compressive force between the respective rolls 11, 12, 17, and 18. The tensions $T_1$ and $T_4$ applied to the strip A preferably should be sufficient to prevent slippage between the rolls 11, 12, 17, and 18 and the strip A. The motors 25 and 25' are energized to advance the strip A through the mill 10 by imparting torque to the back-up rolls 11 and 12 which in turn drive the idling work rolls 17 and 18 through the strip A. The upper back-up roll 12 and the work rolls 17 and 18 are arranged for floating movement vertically along the plane 15. In a preferred embodiment the roll axes 14, 16, B or C of each of the back-up rolls 11 and 12 and work rolls 17 and 18 may all lie in the single vertical plane 15. However, to attain greater stability for the work rolls 17 and 18, the plane defined by the axes B and C of the work rolls 17 and 18 is preferably tilted very slightly with respect to the plane 15 defined by the axes 14 and 16 of the back-up rolls 11 and 12. Any suitable tilt angle as known in the art may be defined between the plane of the work rolls 17 and 18 and the plane 15 of the back-up rolls 11 and 12. Preferably an angle of about 10° and most preferably less than about 5° is used. The plane of the work rolls 17 and 18, if tilted at all, should preferably be tilted in a direction to further deflect the strip A, namely, clockwise as viewed in FIG. 1.

However, it may not be essential in accordance with this invention that the plane of the work rolls 17 and 18 be tilted with respect to the plane 15 of the back-up rolls 11 and 12 and such an expedient should only be employed in the event that it is necessary to provide stabilization of the work rolls 17 and 18. Alternatively, it is possible though not desirable to stabilize the work rolls 17 and 18 by the use of a stabilizing roller engaging the free surface of the work rolls 17 and 18 which in FIG. 1 is the surface to which the coolant and lubricant are directed. Such an approach would inhibit the application of coolant and lubricant.

In any event if it is desired to tilt the plane of the work rolls 17 and 18 relative to the plane 15 of the back-up rolls 11 and 12, the degree of tilt should not be so great as to prevent the application of pressure by means 23 to the three roll bites.

It is preferred in accordance with this invention that the presser means 23 be adapted to apply the pressure to the respective rolls 11, 12, 17, and 18 rather than generating such pressure between the respective rolls solely by means of the tension applied to the strip as in the Franek et al. apparatus.

When the mill 10 is powered up and put under reasonable separating force by the presser means 23, the three reduction points are attained as shown in FIG. 1.

It is desirable that the reduction attainable per pass be maximized so that the number of rolling passes, total rolling time, and lead and tail scrap can be minimized.

The amount of reduction attainable per pass is limited by the strip tensile strength. When the maximum strip tension exceeds the strip tensile strength, the strip will break. It is, therefore, desirable to reduce the maximum strip tension as much as possible. By minimizing the maximum strip tension, the maximum attainable reduction per pass should be increased.

It is also desirable that the amount of forward recoiler tension that need be applied to the metal strip to pull the metal strip through the mill be minimized. A reduction in the minimum amount of forward recoiler tension that need be applied provides such benefits as the ability to use smaller recoilers to carry out the rolling process and the ability to reduce the tightness of the coil formed on the recoiler which assists in subsequent anneals performed on the coiled metal strip.

In the cooperative rolling process, the metal strip A is pulled through the mill 10 by the exit back-up roll motor and the recoiler, both of which act on metal strip A substantially at or just after the strip exits the third roll bite. Consequently, the maximum strip tension occurs substantially at the third roll bite.

In accordance with the instant invention, a roll spacing means R is provided so that the separating forces applied to the metal strip at selected bites may be reduced by a desired magnitude without changing the magnitude of the compressive force applied by presser means 23. By reducing the separating force at the first and second roll bites, the metal strip A can be subjected to progressively increasing separating forces as it passes through the mill 10. It has been surprisingly found that by subjecting the strip to differential separating forces, the maximum strip tension and the minimum allowable forward recoiler tension may be reduced. It is believed that the maximum strip tension is reduced in part as a result of a reduction in the friction forces exerted on the strip A in at least some of the roll bites.

Figure 2:
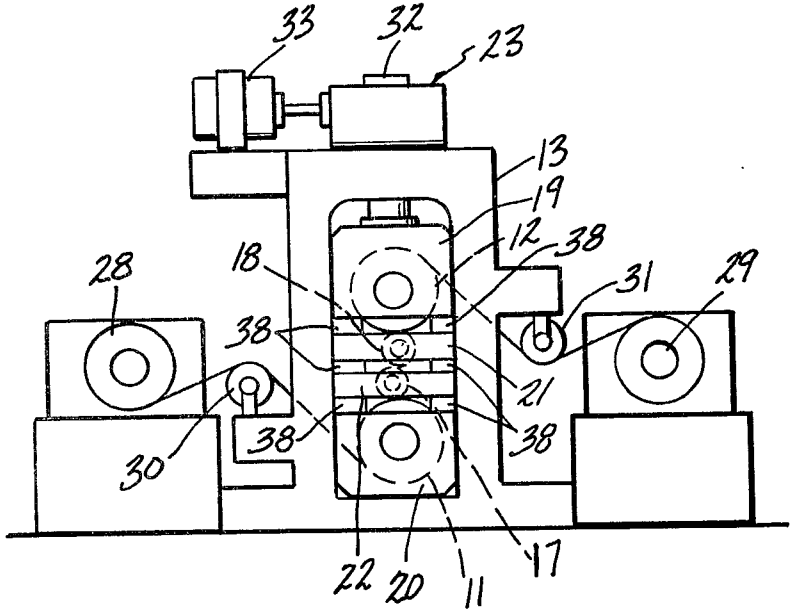
FIG. 2 is a more detailed illustration of the apparatus of FIG. 1.
Figure 4:
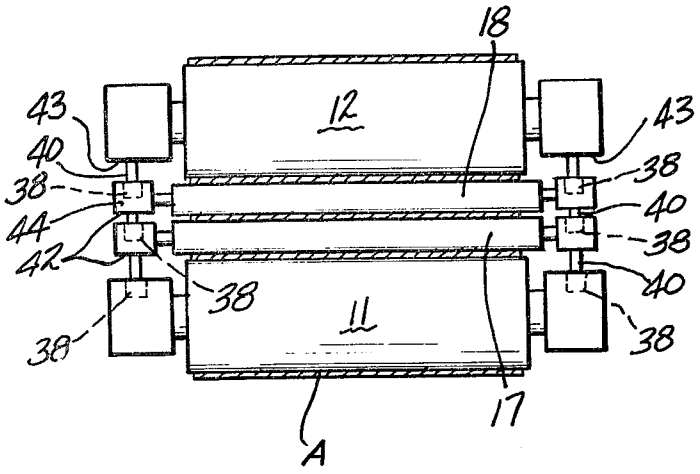
FIG. 4 is a schematic illustration of an apparatus in accordance with this invention including a roll spacing arrangement.

The roll spacing means R comprises a system for moving at least some of the rolls 11, 12, 17 and 18 relative to others of the rolls. In the preferred embodiment, as shown in FIGS. 2 and 4, the roll spacing means R comprises a plurality of hydraulic cylinders or jacks 38 associated with each roll bite. While three sets of hydraulic cylinders are provided, only the set associated with the selected roll bite or roll bites at which the separating force is to be reduced is used. Preferably no more than two sets are used when rolling in a particular direction. The third set is provided for use when mill 10 is used as a reversing mill.

Roll spacing means R preferably comprises a plurality of housings 44 supported by the chocks of the lower back-up roll 11 and the work rolls 17 and 18 and contact surfaces 43 supported by the roll chocks of the upper back-up roll 12. Each housing 44 contains a hydraulic cylinder 38 having an extensible piston rod 40. When extended, each piston rod 40 contacts either a surface 42 of a respective one of the housings 44 or one of the contact surfaces 43. By adjusting the extension of the piston rods 40 relative to the cylinders 38, it is possible to move one roll relative to an adjacent roll.

In a preferred mode of operation, the spacing means R are used to push apart the rolls forming selected roll bits. By moving one roll forming a portion of the roll bite apart from the other roll forming the roll bite, larger roll gaps may be created between the respective rolls. In addition, a portion of the separating force that would ordinarily be applied to the strip A at each of the selected roll bites is diverted to respective ones of the roll support carriages via the hydraulic cylinders 38. The larger roll gaps and the reduced separating forces acting on the strip at the selected roll bites reduce the friction forces acting on the metal strip. At a given roll bite, the friction force exerted on the strip by each of the rolls is described by the equation $$f=\mu SF \quad (1)$$

where f=friction force exerted by the roll $\mu$=coefficient of friction of the roll SF=separating force.

In the preferred mode of operation, the rolls forming the first or entry roll bite, rolls 11 and 17 as shown in FIG. 1, and the work rolls 17 and 18 forming the second roll bite are moved apart by their respective hydraulic cylinders 38 so that the separating forces applied to the strip at these roll bites are reduced by a first force $F_1$ having a first desired magnitude and a second force $F_2$ having a second desired magnitude, respectively. Ideally, $F_1$ has a magnitude substantially equal to twice the magnitude of $F_2$. This is done so as to minimize roll bending and to avoid overloading any of the roll support structures. The rolls forming the third roll bite are not moved apart by their hydraulic cylinders. In this manner, the separating force acting at the entry roll bite preferably has the lowest magnitude and the separating force acting at the exit roll bite preferably has the greatest magnitude. It is also preferred that the separating forces acting on the strip A progressively increase as the strip passes through the mill 10.

Table I illustrates a comparison of the rolling parameters for a conventional cooperative rolling mill and a cooperative rolling mill utilizing the differential separating force concept described above to achieve a 45% reduction in gage of a copper alloy CDA 688 strip in soft temper.

TABLE I

| | Conventional Co-op Mill | Differential Separating Force |
|---|---|---|
| Max. Strip Tension (lbs.) | 15700 | 13900 |
| Min. Allowable Recoiler Tension (lbs.) | 12800 | 11300 |
| Front Tension Factor | 0.73 | 0.66 |
| Separating Force (lbs.) | 106,000 (all roll bites) | 85,600 (1st roll bite) 110,600 (2d roll bite) 135,600 (3d roll bite) |

As can be seen from the above table, the maximum strip tension, the minimum allowable recoiler or forward tension, and the front tension factor were reduced using the differential separating force concept of the instant invention. The front tension factor is the ratio of the strip tensile force to the strip yield load. Since these parameters have been reduced using the differential separating force concept, the maximum reduction attainable per pass should be increased.

In addition to using the differential separating force concept described above, it has also been discovered that the strip tension can be further reduced by driving at least one of the work rolls 17 and 18 with a positive torque having a predetermined value. The predetermined torque value would depend upon the metal or metal alloy being rolled, its temper, the desired reduction, etc. In a preferred embodiment, both of the work rolls 17 and 18 are driven. It should be noted that the back-up rolls 11 and 12 would continue to be speed regulated.

Figure 5:
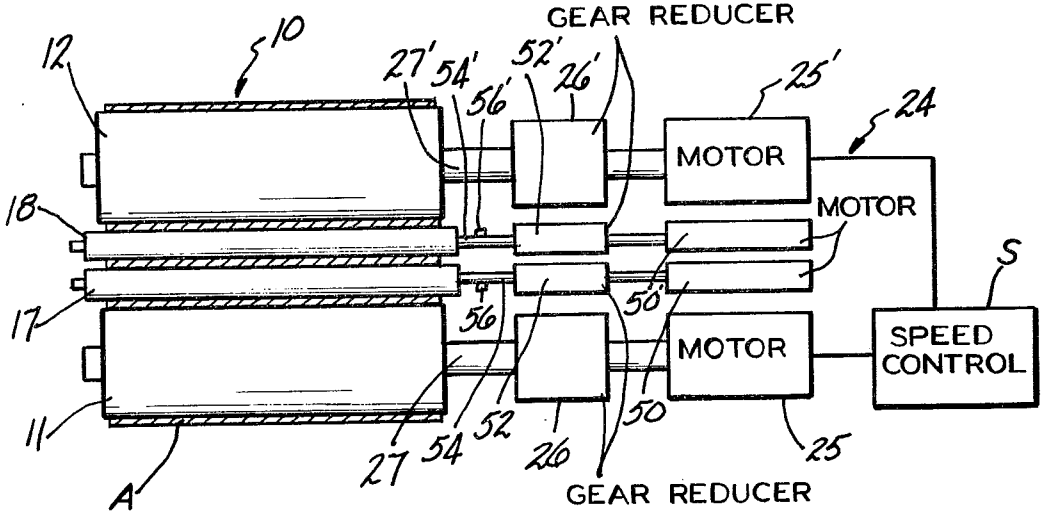
FIG. 5 is a partial view showing an alternative drive system for the rolls of the apparatus of FIG. 1.

As shown in FIG. 5, work rolls 17 and 18 may be driven by individual motors 50 and 50'. Each motor 50 and 50' is connected to a respective one of the rolls 17 and 18 through a respective one of reduction gear boxes 52 and 52' and drive spindles 54 and 54'. In order to insure that the work rolls are being driven at the predetermined torque values, sensors 56 and 56' may be mounted on the drive spindles 54 and 54' to monitor the torques being applied to the work rolls 17 and 18. When an applied torque differs from a predetermined torque value, sensor 56 and/or 56' preferably transmit a signal to the motor driving the work roll. The motor adjusts itself so that any difference between the predetermined torque value and the applied torque value is eliminated. Motors 50 and 50' and sensors 56 and 56' may comprise any suitable conventional drive motors and sensors as are known in the art. In lieu of the work roll drive system shown in FIG. 5, any suitable drive system for applying a positive torque to the work rolls may be utilized.

Since the work roll drive system is torque regulated and not speed regulated, work rolls 17 and 18 should be free to move at the speed of the metal strip A wrapping each of the rolls. Consequently, no friction hills should be developed and the work rolls 17 and 18 should assist in pulling the strip A through the mill 10. By having the work rolls 17 and 18 assist in pulling the strip through the mill 10, strip tension may be further reduced throughout the mill. As a result, the maximum strip tension and the minimum forward recoiler tension that need be applied to the strip may be reduced.

However, the maximum torque that could be applied to each work roll by its motor would be limited by not permitting slippage to occur between the work roll and the contacting strip except in the roll bite, i.e. the strip and the contacting roll move at substantially the same speed. The capability to keep the roll and strip moving at the same speed is dependent on the magnitude of the wrap force that can be transmitted from the work roll to the strip. The available wrap force must first be utilized to maintain a moment balance for the intrinsic forces that act on the work roll, i.e. wedge forces, separating forces, and roll bite friction forces. After accounting for this moment balance, any wrap force that remains can be used to reduce the strip tension through powering one or both of the work rolls. If desired, more wrap force could be made available by increasing the roll coefficient of friction through any well known means.

It is apparent then in accordance with the present invention that through the use of roll spacing means R preferably comprising a system of hydraulic cylinders in a cooperative rolling mill, it is possible to reduce the maximum strip tension and the minimum allowable forward tension force and thereby, increase the maximum attainable reduction per pass by applying differential separating forces to the strip. It is also possible to further reduce the maximum strip tension and the minimum allowable forward tension force by driving one or both of the work rolls 17 and 18 with a positive torque in combination with the differential separating force concept described herein.

In the cooperative rolling process of the present invention utilizing the apparatus 10 described results in three rolling reductions being accomplished in one pass of the strip A through the mill 10 by active mechanisms which all tend towards reducing the separating force for rolling as compared to that required in other systems. As shown in FIG. 1, it is believed that the forward and back tensions $T_2$ and $T_3$ in the reduction zones for this process are principally provided by the wrapping of the strip A around the driven back-up rolls 11 and 12 in such a way as to provide shear drag on the strip. Since the workpiece or strip A encompasses the slower large driven roll 11, little or no slipping should occur around the periphery of this roll 11 because of the back tension $T_1$ provided by the decoiler/recoiler 28 and the shear drag of the roll itself. A similar situation exists for the upper back-up roll 12 because of the forward tension $T_4$ and the shear drag of this roll. The driven uppermost large back-up roll 12 should be driven at a peripheral speed consistent with the final desired gage of the strip A. Accordingly, it will be rotating at a peripheral speed $V_4$ relative to the speed $V_1$ of the lower back-up roll 11 which is inversely proportional to the entry and exit strip thicknesses in the roll stand 10.

The ratio between the diameters of the back-up rolls 11 and 12 and the diameters of the work rolls 17 and 18 should preferably range from about 2:1 to 9:1 and most preferably from about 3:1 to 8:1. This results in a distinct difference in the diameters of the respective work 17 and 18 and back-up rolls 11 and 12. However, the difference in diameters need not be as drastic as required in accordance with some prior art apparatuses. The apparatus as shown in FIG. 1 is adapted to lower the separating forces preferably by a minimum of 2:1 as compared to a conventional four high mill.

The amount of wrap of the strip about the driven back-up rolls 11 and 12 depends on the friction and lubricity conditions between the strip A and the respective back-up roll 11 and 12 and may be set as desired to assure minimization of any slippage which might occur between the strip A and the rolls. The total force or pressure between the top and bottom back-up rolls 12 and 11 is positive and less than that required for conventional rolling. Since the gage of the resulting strip A is determined by the relative peripheral speed ratio between the upper and lower back-up rolls 12 and 11, the apparatus 10 is generally insensitive to the pressure applied by the presser means 23 over a reasonable range of pressure.

While in the preferred embodiment, a particular roll spacing means R has been shown, any suitable conventional roll spacing arrangement as are known in the art may be used to space the rolls.

While in the preferred embodiment, the roll spacing means R have been described as pushing the rolls apart, differential separating forces may also be achieved by using the roll spacing means to compress selected ones of the rolls together. However, the greatest separating force magnitude should again be at the third or exit roll bite.

The invention is believed to be widely applicable to any metal or alloy susceptible of plastic deformation including, but not limited to, iron and iron alloys, copper and copper alloys, nickel and nickel alloys, and aluminum and aluminum alloys.

While a vertical arrangement of the roll stack has been shown, they can be arranged horizontally or otherwise as desired. It has been found possible in practice to operate the aforenoted mill 10 without the use of bridle rolls so that the tensions $T_1$ and $T_4$ are provided by the decoilers/recoilers 28 and 29. However, if desired, bridle rolls or other suitable means could be employed to provide those tensions.

The term "generally in a plane" as used in reference to the arrangement of the various roll axes 14, 16, B, and C is intended to include any slight tilting of the plane of the work roll axes B and C relative to the plane 15 of the back-up roll axes 14 and 16 in accordance with this invention.

In accordance with the present invention, it is possible to employ a substantial number of passes through the mill without so increasing the separating force so as to render the mill inoperative for further reduction and require an anneal. Further, the separating force generated by the process and apparatus of this invention is considerably lower than would be expected for a conventional rolling mill. The process and apparatus in accordance with this invention are limited only by the ability of the strip to absorb plastic deformation.

The rolling mill apparatus disclosed in co-pending U.S. patent application Ser. No. 167,084, now U.S. Pat. No. 4,329,863, is uniquely suited to carry out the differential separating force concept described hereinbefore.

The patents, patent applications, publications, and articles set forth in this application are intended to be incorporated by reference herein.

It is apparent that there has been provided in accordance with this invention modifications to a cooperative rolling system for increasing the maximum attainable reduction per pass which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A process for rolling metal or metal alloy material and increasing the maximum reduction in material thickness obtainable per pass, said process comprising:

providing a rolling mill having a plurality of rolls forming a plurality of roll bites through which said material passes, at least one of said rolls forming two of said roll bites with at least two adjacent one of said rolls;

passing said material through said mill in a serpentine arrangement;

applying a compressive force of predetermined magnitude to said rolls to create a separating force having a desired magnitude and obtain a reduction in said material thickness at each of said roll bites; and subjecting said material to increasing separating forces as said material passes from an entry one of said roll bites to an exit one of said roll bites while maintaining the magnitude of said compressive force substantially constant, said subjecting step comprising reducing the magnitude of said separating force applied to said material at at least one of said roll bites by creating a reducing force having a desired magnitude at said at least one roll bite.

2. The process of claim 1 wherein said step of reducing said separating force magnitude further comprises:

reducing said separating force magnitude at each of said roll bites except said exit roll bite by creating a reducing force at each said roll bite except said exit roll bite.

3. The process of claim 2 wherein said step of reducing said separating force magnitude further comprises:

reducing said separating force magnitude at a second roll bite just prior to said exit roll bite so that said second roll bite separating force has a magnitude less than the separating force magnitude at said exit roll bite; and reducing said separating force magnitude at said entry roll bite so that said entry roll bite separating force has a magnitude less than the separating force magnitude at said second roll bite, so that said material is subjected to said increasing separating forces and maximum tension in said material is reduced as said material passes through said mill.

4. The process of claim 1 wherein:

said step of providing a mill further comprises providing means for supporting said rolls; and said separating force magnitude reducing and reducing force creating step comprises diverting a portion of said separating force at said at least one roll bite to said means for supporting said rolls forming said at least one roll bite.

5. The process of claim 4 further comprising:

providing said roll supporting means with means for spacing said rolls forming each of said roll bites; and said step of diverting a portion of said separating force comprising adjusting said spacing means to space said rolls forming said at least one roll bite so as to reduce said separating force magnitude at said at least one roll bite by said desired magnitude.

6. The process of claim 5 wherein said step of providing spacing means comprises providing at least one hydraulic cylinder between each of said roll supporting means.

7. The process of claim 4 further comprising:

applying a forward tension force having a magnitude to said material; and said step of diverting a portion of said separating force reducing the magnitude of said forward tension force that need be applied to said material to obtain said maximum reduction.

8. The process of claim 1 wherein said step of providing a mill comprises providing a rolling mill having two back-up rolls and two work rolls forming said plurality of roll bites;

driving said back-up rolls at a speed ratio substantially equal to a desired reduction in said material thickness; and driving at least one work roll at a desired value of torque so that said at least one work roll moves substantially at the speed of said material contacting said at least one work roll.

9. The process of claim 8 wherein said step of driving said at least one work roll comprises driving both of said work rolls at desired values of torque so that each of said work rolls moves substantially at the speed of said material contacting it.

10. The process of claim 1 wherein said step of passing said material through said mill comprises passing a metal or metal alloy strip through said mill.

11. A rolling mill apparatus for reducing the thickness of a strip material, said mill comprising:

at least two back-up rolls and at least two work rolls forming a plurality of roll bites through which said material passes in a serpentine manner, said material being at least partially wrapped about each of said rolls;

at least one of said work rolls and two adjacent ones of said rolls forming two of said roll bites;

means for applying a compressive force of predetermined magnitude to said rolls for causing a reduction in said material thickness at each of said roll bites, said compressive force further creating a separating force of a given magnitude at each of said roll bites;

means for subjecting said material to increased separating force as said material passes from an entry one of said roll bites to an exit one of said roll bites while maintaining the magnitude of said applied compressive force substantially constant, said subjecting means including means for creating a reducing force at at least one of said roll bites to reduce the magnitude of said separating force applied to said material at said at least one roll bite;

means for driving said back-up rolls at a speed ratio substantially equal to a desired reduction in said material thickness; and means driving at least one work roll at a desired value of torque so that said at least one work roll moves substantially at the speed of said material wrapping said at least one work roll and assisting in pulling said material through said mill, whereby said subjecting means and said driving means reduce the overall tension in said material as said material passes through said mill and increase the amount of reduction obtainable per pass.

12. The apparatus of claim 11 wherein said at least one work roll driving means comprises:

means for driving both of said work rolls at desired values of torque so that each of said work rolls moves substantially at the speed of said material contacting it.

13. The apparatus of claim 11 wherein said reducing force creating means comprises:

means for creating a reducing force at each of said roll bites except said exit roll bite.

14. The apparatus of claim 13 wherein said reducing force creating means comprises:

means for creating a first reducing force at a second roll bite just prior to said exit roll bite so that said second roll bite separating force has a magnitude less than the separating force magnitude at said exit roll bite; and means for creating a second reducing force at said entry roll bite so that said entry roll bite separating force has a magnitude less than the separating force magnitude at said second roll bite, so that said material is subjected to sequentially increasing separating force magnitudes and maximum tension in said material is reduced as material passes through said mill.

15. The apparatus of claim 11 further comprising:

means for supporting each of said rolls; and said reducing force creating means comprising means for diverting a portion of said separating force at said at least one roll bite to said roll supporting means for said rolls forming said at least one roll bite.

16. The apparatus of claim 15 wherein said diverting means comprises:

means for spacing said rolls forming said at least one roll bite.

17. The apparatus of claim 16 wherein said spacing means comprises:

at least one hydraulic cylinder between said roll supporting means associated with said rolls forming said at least one roll bite.

18. The apparatus of claim 11 further comprising:

means for applying a forward tension force having a magnitude to said material to pull said material through said roll bites; and said reducing force creating means also reducing the magnitude of said forward tension force required to pull said material through said roll bites.

19. The apparatus of claim 11 wherein:

said material comprises a metal or metal alloy strip.

* * * * *